US009194542B2

(12) United States Patent
Lin et al.

(10) Patent No.: US 9,194,542 B2
(45) Date of Patent: Nov. 24, 2015

(54) RETRACTABLE END-CAP FOR LED TUBE

(71) Applicant: Lightel Technologies, Inc., Renton, WA (US)

(72) Inventors: Ching-Feng Lin, Taipei (TW); Chia-Yiu Maa, Bellevue, WA (US); Chun-Te Yu, Bellevue, WA (US); Pai-Sheng Shen, Bellevue, WA (US)

(73) Assignee: Lightel Technologies, Inc., Renton, WA (US)

( * ) Notice: Subject to any disclaimer, the term of this patent is extended or adjusted under 35 U.S.C. 154(b) by 0 days.

(21) Appl. No.: 14/243,870

(22) Filed: Apr. 2, 2014

(65) Prior Publication Data

US 2015/0176771 A1 Jun. 25, 2015

Related U.S. Application Data

(63) Continuation-in-part of application No. 14/135,319, filed on Dec. 19, 2013.

(51) Int. Cl.

| | |
|---|---|
| ***F21V 21/00*** | (2006.01) |
| ***F21K 99/00*** | (2010.01) |
| ***H01R 33/08*** | (2006.01) |
| ***F21V 25/04*** | (2006.01) |
| ***H01R 33/96*** | (2006.01) |
| *F21Y 101/02* | (2006.01) |

(52) U.S. Cl.

CPC ..... *F21K 9/175* (2013.01); *F21V 25/04* (2013.01); *H01R 33/08* (2013.01); *H01R 33/0836* (2013.01); *H01R 33/96* (2013.01); *F21Y 2101/02* (2013.01)

(58) Field of Classification Search

CPC ..... F21K 9/17; F21K 9/175; F21V 19/008; F21V 23/06; F21V 23/002; F21S 4/008

See application file for complete search history.

(56) References Cited

U.S. PATENT DOCUMENTS

| | | | | |
|---|---|---|---|---|
| 2007/0242466 | A1* | 10/2007 | Wu et al. | 362/362 |
| 2010/0219739 | A1* | 9/2010 | Kuo et al. | 313/318.12 |
| 2012/0099322 | A1* | 4/2012 | Simon et al. | 362/249.02 |

* cited by examiner

*Primary Examiner* — Evan Dzierzynski
*Assistant Examiner* — Zachary J Snyder
(74) *Attorney, Agent, or Firm* — Han IP Corporation

(57) ABSTRACT

Embodiments of an end-cap with retractable and rotatable pin for an LED tube are described. In one aspect, an end-cap for an LED tube may include an end-cap housing, an end-cap base assembly, a power-pin assembly, and at least one elastic component. The power-pin assembly may include at least one power pin thereon and configured to connect to an external power source. The power-pin assembly may protrude out of a center opening of the end-cap housing. The end-cap base assembly may have at least one power connector one end of which is connected to the body of the LED tube to receive electric power. The at least one elastic components may reside inside the end-cap housing and is placed between the power-pin assembly and the end-cap base assembly. The power connector may connect to the at least one power pin when the at least one elastic component is pressed.

12 Claims, 8 Drawing Sheets

RETRACTABLE END-CAP FOR LED TUBE

CROSS REFERENCE TO RELATED PATENT APPLICATION

The present disclosure is a continuation-in-part of U.S. patent application Ser. No. 14/135,319, filed on Dec. 19, 2013, which claims the priority benefit of China Patent Application No. 201310636570.5 filed on Nov. 27, 2013, which applications are herein incorporated by reference.

TECHNICAL FIELD

The present disclosure relates to the field of luminaires and, more particularly, to a retractable end-cap of a lighting tube.

BACKGROUND

When a fluorescent tube lamp in a linear lighting fixture is retrofitted with a light-emitting diode (LED) tube, line voltage of 120V or 277V or higher is applied directly to the lamp-holders of the fixture and to the end-caps of the LED tube. If the LED tube employs double-end wiring, when one end of the LED tube connects with the power source, the other end of the LED tube instantly becomes live with electricity. This represents an electrical shock hazard for the installer of the LED tube.

One approach provides an LED tube wherein each of the two end-caps of the LED tube contains an extruded, spring-based safety switch. Before installation, the safety switch is not engaged and thus the bi-pins on the end-cap remain disconnected from the internal electric circuit of the LED tube. During installation, when one end-cap of the LED tube is inserted into the lamp-holder of a linear fixture, the external power source connects to the bi-pins on the end-cap, and at the same time the safety switch is pressed, thus connecting the bi-pins on the end-cap to the internal electric circuit of the LED tube. However, since the bi-pins of the remaining end-cap of the LED tube have not yet been inserted into the other lamp-holder on the linear fixture, the remaining safety switch is not engaged and therefore the remaining end-cap remains disconnected from both the external power source and the internal electric circuit of the LED tube. At this time, the installer can still safely touch the bi-pins of the disconnected end-cap with their bare hands without any risk of electrical shock. There are, however, two drawbacks with the inventive concept of the present disclosure. Firstly, when the lamp-holder loosens over time, the extruded, spring-based safety switch on the end-cap may not be properly engaged to connect the bi-pins to the internal circuit when the LED tube is installed into a linear fixture, resulting in poor connection between the LED tube and the external power source. Secondly, the length of the linear fixture varies. If an LED tube with the extruded, spring-based safety switch is inserted into a linear fixture that is slightly too long, the extruded, spring-based safety switch on the end-cap may not be properly engaged to connect the bi-pins to the internal circuit, resulting in poor connection between the LED tube and the external power source. If the linear fixture is shorter than the LED tube, it is not possible to insert the LED tube into the fixture.

Another approach provides an LED tube where a spring-based, floating end-cap is used on the LED tube. The bi-pins of the end-cap connect to the internal circuit of the LED tube. Before installation, the bi-pins are hidden inside the floating end-cap, and thus there is no risk of the installer making contact with the bi-pins. When the tube is inserted into a linear fixture, the spring-based, floating end-cap is pressed and retracts towards the center of the tube, thus exposing and enabling the bi-pins to connect to the external power source. This second approach solves the problem with the extruded, spring-based safety switch disclosed in the first approach mentioned above, where poor connection arises due to a loosened lamp-holder. However, this spring-based, floating end-cap design still does not solve the problem of differences in the length of the linear fixture, given the fact that the length of the LED tube with the floating end-caps is fixed. Moreover, the floating end-caps present another challenge; namely, the installer cannot see the bi-pins during installation because they are hidden inside the end-cap until the end-cap is pressed. As such, the installer needs to press both end-caps at the same time during installation to expose and insert the bi-pins into the lamp-holders. This is a very difficult task to perform when installing a 4-ft or 5-ft LED tube.

SUMMARY

In one aspect, an end-cap of a LED tube may include an end-cap housing, a power-pin assembly, an end-cap base assembly, and an elastic component disposed between the power-pin assembly and the end-cap base assembly. The power-pin assembly may include at least one power pin thereon, the at least one power pin configured to connect to an external power source. The power-pin assembly may protrude out of a center opening of the end-cap housing. The end-cap base assembly may include at least one power connector thereon. The at least one power connector may be configured to connect to a body of the LED tube to supply power to the LED tube. The at least one power connector may connect to the at least one power pin when the elastic component is pressed. The at least one power connector may remain separate from the at least one power pin when the elastic component is not pressed.

In some embodiments, an interlocking mechanism may exist between the end-cap housing and the power-pin assembly such that the power-pin assembly is rotatable inside the center opening of the end-cap housing. In some embodiments, the interlocking mechanism may include a gear-style lock between the end-cap housing and the power-pin assembly such that, when the power-pin is pressed into the center opening of the end-cap housing, the power-pin assembly is released from the gear-style lock and becomes rotatable. Further, when the power-pin assembly is released, the elastic component may push the power-pin assembly into a gear locked position with the center opening of the end-cap housing.

In some embodiments, there may be at least one electricity-conducting surface area at an end of the at least one power pin that connects with the at least one power connector such that, when the power-pin assembly is rotated, the at least one electricity-conducting surface area remains electrically connected with the at least one power connector while the elastic component is pressed.

In some embodiments, a rotational range of the power-pin assembly in the center opening of the end-cap housing may be approximately −90 to 90 degrees.

In some embodiments, the at least one power connector may include an elastic cylindroid.

In some embodiments, the at least one power connector may contain a spring therein.

In some embodiments, the at least one power connector may be retractable in a direction along a longitudinal axis of the LED tube, and a retracting range of the at least one power connector may be 1-10 mm approximately.

In some embodiments, the elastic component may include a spring.

In some embodiments, a mechanism may exist to keep a position of the elastic component stationary inside the end-cap. In some embodiments, the mechanism may include at least one first wedge on the end-cap base assembly positioned inside the elastic component and at least one second wedge on the power-pin assembly positioned outside of the elastic component.

In some embodiments, when the elastic component is not pressed, a distance of separation between the at least one power connector and the at least one power pin may be in a range of 2-10 mm approximately.

The claims and advantages will be more readily appreciated as the inventive concept becomes better understood by reference to the following detailed description and the accompanying drawings showing exemplary embodiments, in which like reference symbols designate like parts. For clarity, various parts of the embodiments in the drawings are not drawn to scale.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Overview

Various implementations of the present disclosure and related inventive concepts are described below. It should be acknowledged, however, that the present disclosure is not limited to any particular manner of implementation, and that the various embodiments discussed explicitly herein are primarily for purposes of illustration. For example, the various concepts discussed herein may be suitably implemented in a variety of LED tubes having different form factors and light output.

The present disclosure provides a first inventive designs of an end-cap for the LED tube. It ensures that an LED tube is activated only when both end-caps of the LED tube are inserted into the linear fixture sockets, thus protecting the installer from electrical shock during installation. The present disclosure also eliminates the drawbacks of the previous approaches and increases the safety and usability of the LED tube equipped with the new end-cap.

The retractable end-cap for LED tube of the first inventive design provides two important benefits. Firstly, it prevents electric shock hazards by enabling the retractable end-cap to function as a safety switch. Secondly, it provides a means for adjusting the overall length of the LED tube for fitting the tube into fixture with a slight variation in length. There are, however, two drawbacks with the design of the first inventive design. Firstly, the retractable end-cap cannot be pre-assembled and it has to be assembled piece-by-piece onto the LED tube. This is less desirable for a modular manufacturing process and thus prevents the end-cap from being made and sold independently of the LED tube. Secondly, the connecting assembly that connects the end-cap housing to the LED tube is fixed in its orientation, thus preventing the LED tube from adjusting the direction of emitted light. For applications such as vending machine lighting, it is often necessary to rotate the light direction of an LED tube by either 45 or 90 degree from its normal position in order to shine the light directly toward the merchandizes in the vending machine. The first inventive design of the present disclosure cannot support such applications.

A second inventive design of the present disclosure overcomes the two drawbacks of the first inventive design by dividing the end-cap housing assembly into two separate assemblies, namely an end-cap housing and a power-pin assembly. This design enables the power-pin assembly to be retractable and rotatable, and also supports the assembling of the end-cap independent of the LED tube body.

Example Implementations of First Inventive Design

Figure 1:
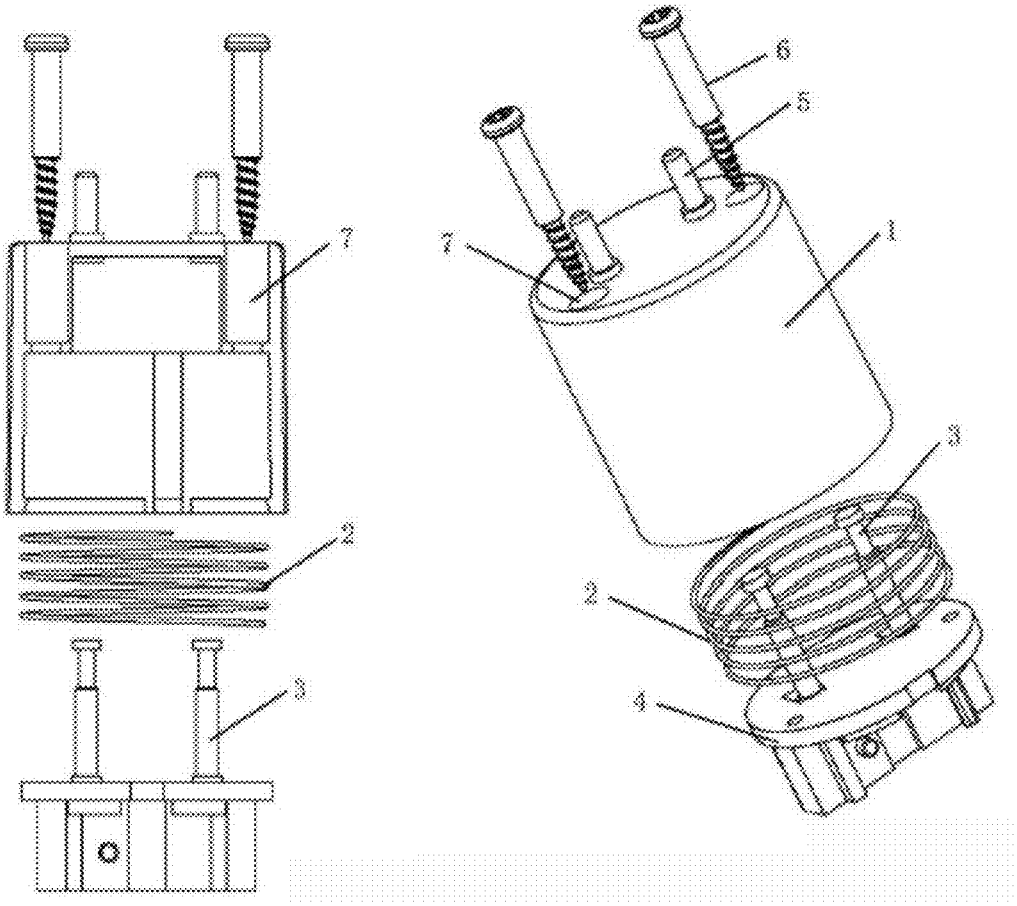
FIG. 1 schematically depicts an embodiment of a LED tube end-cap of the present disclosure.
Figure 2:
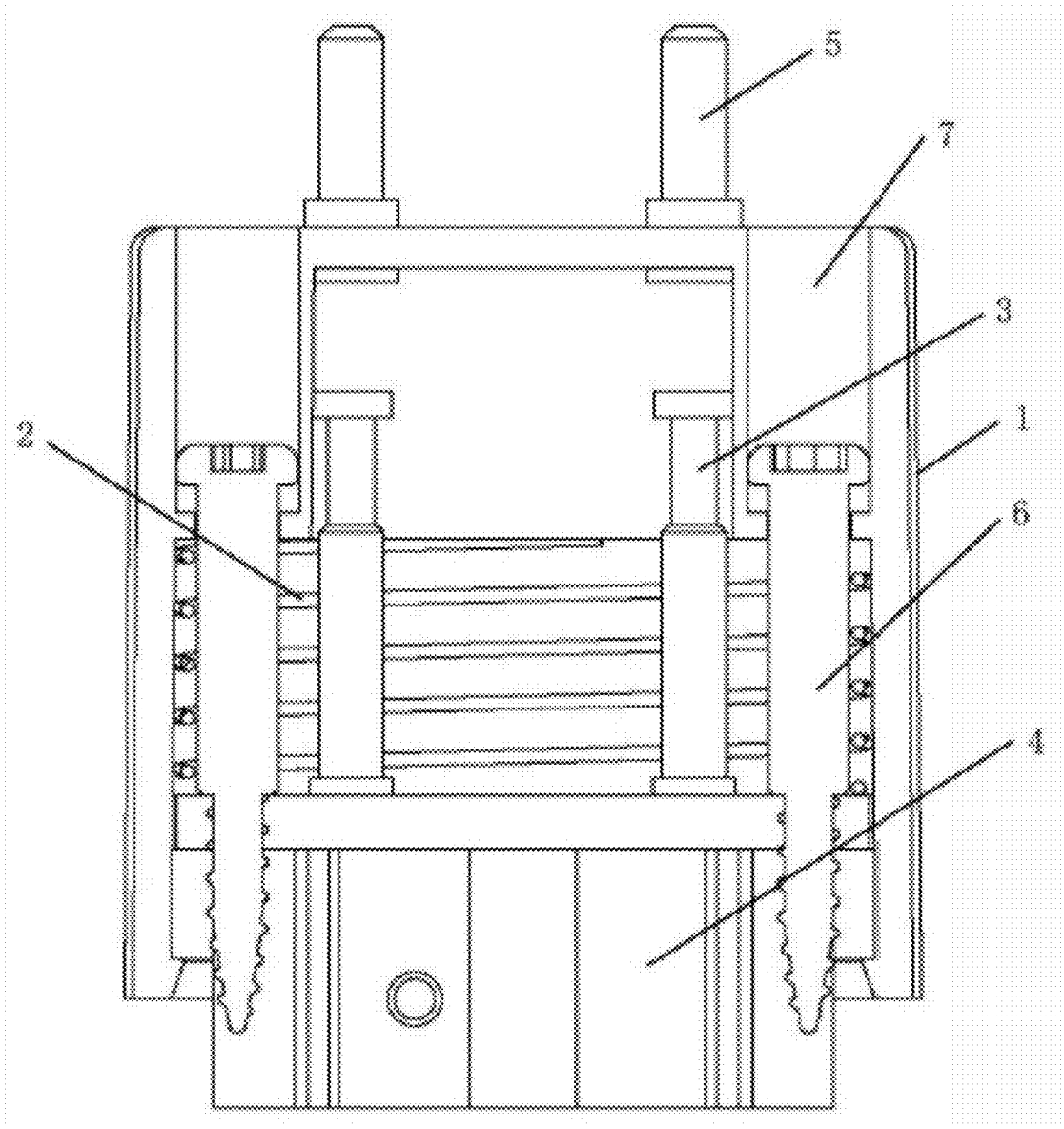
FIG. 2 schematically depicts a cross-sectional view of an embodiment of the present disclosure when the end-cap housing is not pressed.
Figure 3:
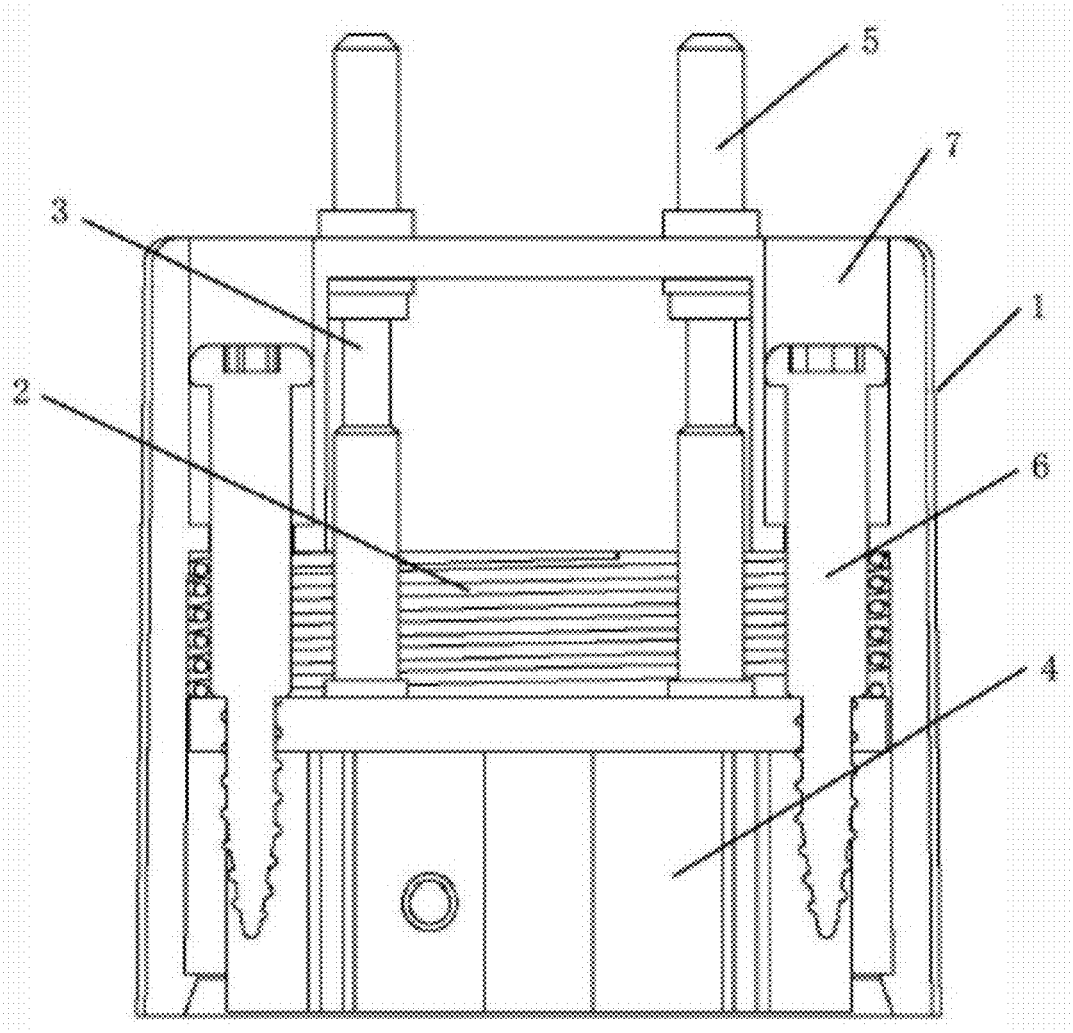
FIG. 3 schematically depicts a cross-sectional view of an embodiment of the present disclosure when the end-cap housing is pressed.

FIG. 1 illustrates one non-limiting example of an LED tube end-cap according to one embodiment of the present disclosure. FIG. 2 illustrates a cross-sectional view of the LED tube end-cap when the end-cap housing is not pressed. FIG. 3 illustrates a cross-sectional view of the LED tube end-cap when the end-cap housing is pressed.

The end-cap comprises of one end-cap housing 1, one elastic component 2 consisting of a spring, and one connecting assembly 4. There are two pins 5 on the end-cap housing 1. The elastic component 2 resides inside the end-cap housing 1. The connecting assembly 4 includes two screws 6. On the upper half of the screw 6 near the screw head there is no screw thread. There are two grooves 7 inside the end-cap housing 1 along a longitudinal axis of the LED tube and the screws 6 reside inside the grooves 7. The bottom half of the screw 6 fastens the end-cap housing 1 onto the connecting assembly 4. When the end-cap housing 1 is pressed along the longitudinal axis of the LED tube, the end-cap housing 1 slides along the upper half of the screws 2 and moves in the direction of the longitudinal axis of the LED tube. There are two power connectors 3 at the bottom of the connecting assembly 4. When the spring 2 is pressed, the two power connectors 3 connect to the two pins 5 on the end-cap housing 1, and when the spring 2 is not pressed, the two power connectors 3 remain separate from the two pins 5, as shown in FIG. 2.

In actual use, one side of the connecting assembly connects with the LED tube body. During the installation of an LED tube with the end-cap described in the present disclosure into a linear fixture, the end-cap housing 1 is pressed, thus causing the end-cap housing to slide along the longitudinal axis of the LED tube and press down on the spring 2. As a result, the two power connectors 3 connect to the two pins 5, as shown in FIG. 3. When the LED tube is taken out of the linear fixture, the pressure on the end-cap housing 1 is removed and the spring 2 pushes the end-cap 1 away from the LED tube, thus separating the two power connectors 3 from the two pins 5.

Figure 4:
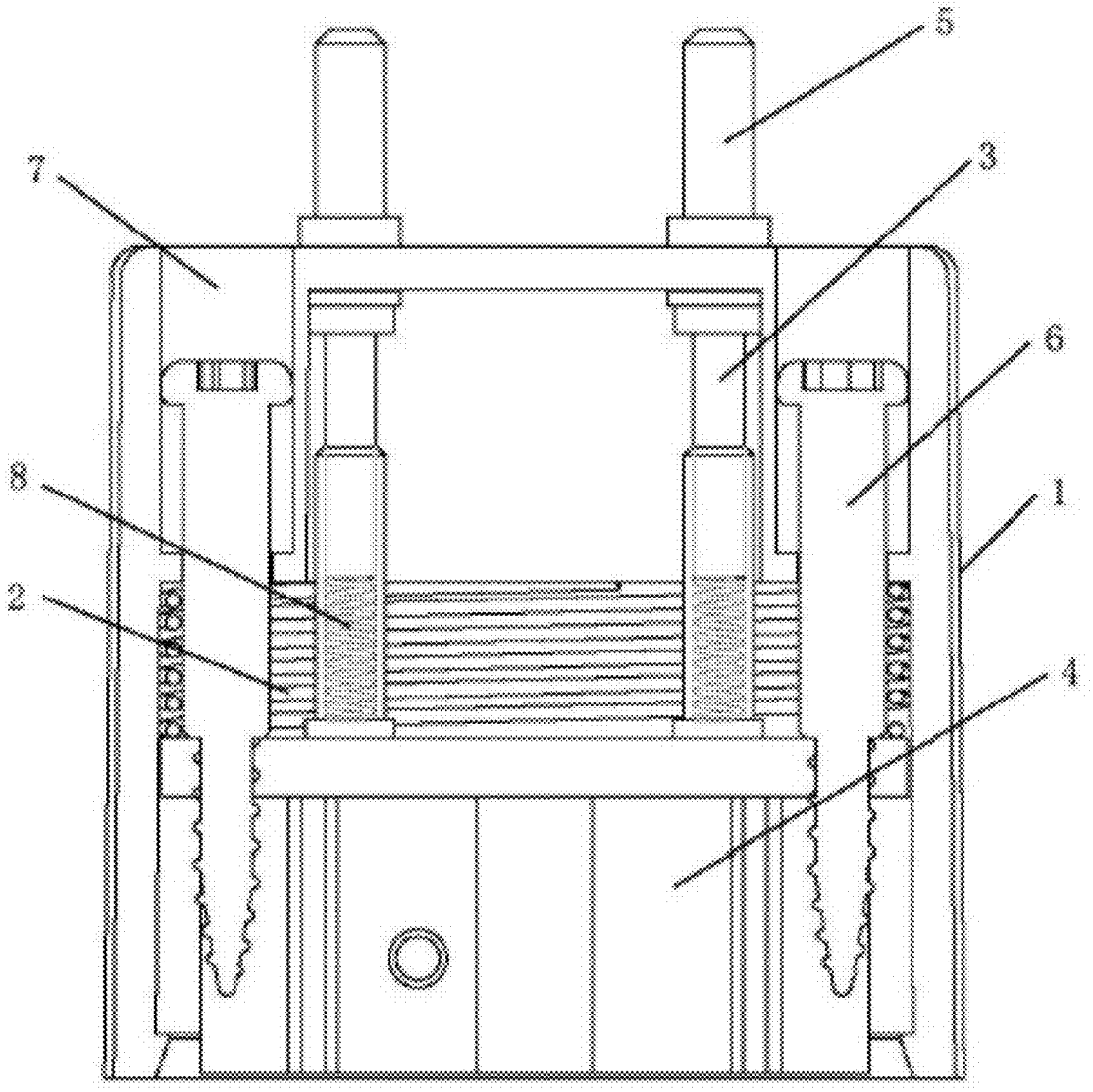
FIG. 4 schematically depicts a cross-sectional view of another embodiment of the present disclosure when the end-cap housing is pressed, and the power connector contains a spring inside for adjusting the total length of the LED tube when the power connector is pressed.

FIG. 4 illustrates the cross-sectional view of another embodiment of the present disclosure when the end-cap housing 1 is pressed. In addition to the components and structure shown in FIG. 1, the two power connectors 3 in FIG. 4 contain a spring 8 that has a 1-10 mm expansion range. After the end-cap housing 1 is pressed along the longitudinal axis of the LED tube until the two pins 5 connect to the two power connectors 3, additional pressure to the end-cap housing 1 causes the two power connectors 3 to retract between 1-10 mm along the longitudinal axis of the LED tube, resulting in an adjustment of the total length of the LED tube. This enables the installation of an LED tube into linear fixtures that vary slightly in length.

While the present disclosure has been described and illustrated in its preferred embodiments, it should be understood that departure therefrom may be made within the scope of the present disclosure, which is not limited to the specific details disclosed herein.

Example Implementations of Second Inventive Design

Figure 5:
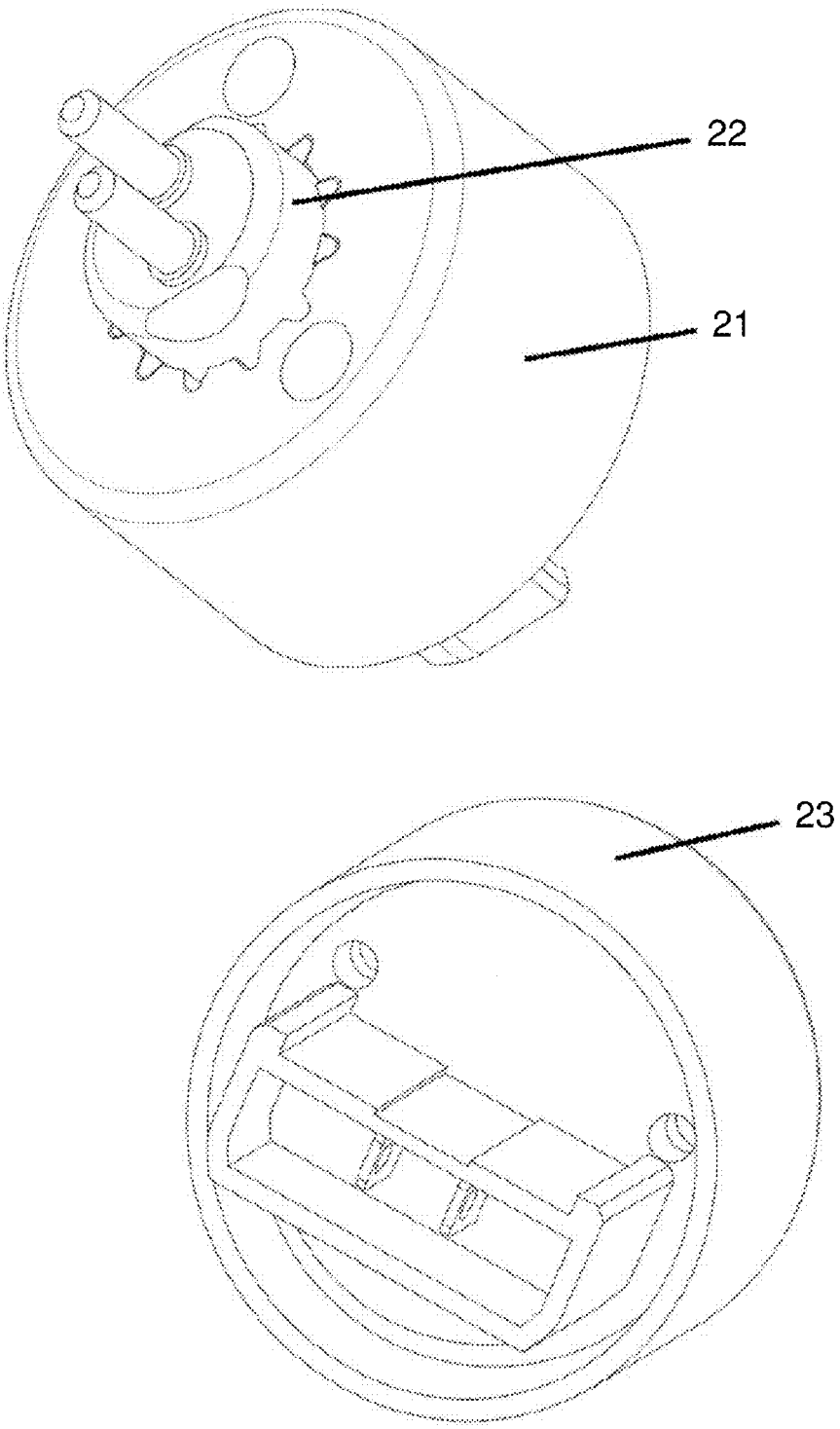
FIG. 5 schematically depicts another embodiment of a LED tube end-cap of the present disclosure.
Figure 6:
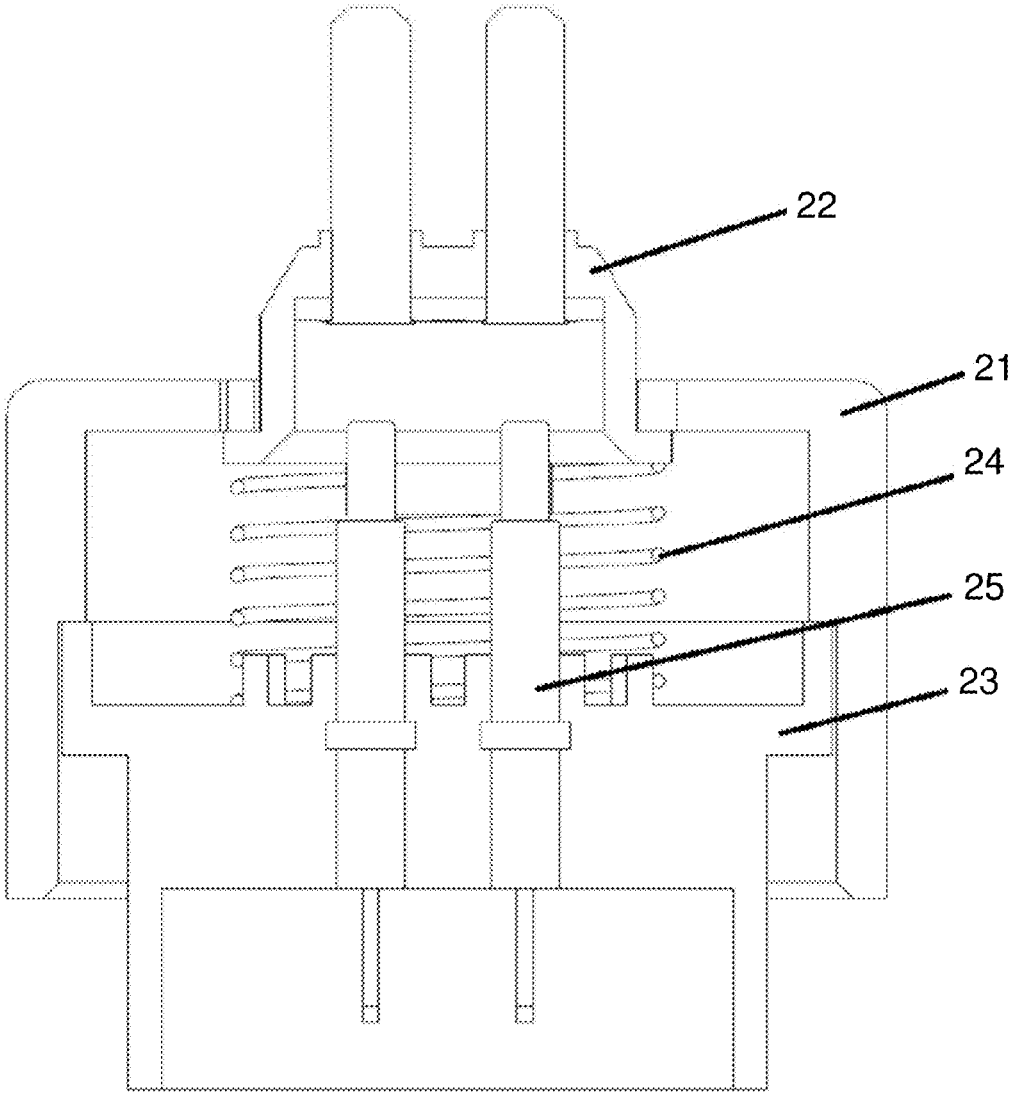
FIG. 6 schematically depicts a cross-sectional view of an embodiment of the present disclosure when the power-pin assembly is not pressed.

FIG. 5 illustrates one non-limiting example of an LED tube end-cap according to one embodiment of the present disclosure. The end-cap comprises of an end-cap housing 21, a power-pin assembly 22, and an end-cap base assembly 23. FIG. 6 illustrates a cross-sectional view of this implementation. FIG. 6 shows, from top to bottom, power-pin assembly 22, end-cap housing 21, an elastic component 24, and two power connectors 25 on the end-cap base assembly 23. Each of the two power connectors 25 may include an elastic cylindroid. In some embodiments, each of the two power connectors 25 may contain a spring therein which is not shown in FIG. 6 for simplicity. The elastic component 24 may be, for example, a spring. There are two pins on the power-pin assembly 22 (not shown). The elastic component 24 resides inside the end-cap housing 21, and is placed between the power-pin assembly 22 and the end-cap base assembly 23. When the power-pin assembly 22 is pressed along a longitudinal axis of the LED tube, it presses against the spring 24, causing the two power connectors 25 to connect to the two pins on the power-pin assembly 22. When the elastic component 24 is not pressed, the two power connectors 25 remain separate from the two pins on the power-pin assembly 22.

In actual implementation, the end-cap base assembly 23 may connect with the LED tube body. During the installation of an LED tube with the end-cap described herein into a linear fixture, the power-pin assembly 22 is pressed, thus causing it to slide along the longitudinal axis of the LED tube and press down on the elastic component 24. As a result, the two power connectors 25 connect to the two pins on the power-pin assembly 22. When the LED tube is taken out of the linear fixture, the pressure exerted by the power-pin assembly 22 on the elastic component 24 is removed and the elastic component 24 pushes the power-pin assembly 22 away from the LED tube, thus separating the two power connectors 25 from the two pins on the power-pin assembly 22.

In addition to the components and structure shown in FIG. 6, the two power connectors 25 may contain a spring that has an expansion range of approximately 1-10 mm. After the power-pin assembly 22 is pressed along the longitudinal axis of the LED tube until the two pins on the power-pin assembly 22 connect to the two power connectors 25, additional pressure to the power-pin assembly 22 causes the two power connectors 25 to retract between approximately 1-10 mm along the longitudinal axis of the LED tube, resulting in an adjustment of the total length of the LED tube. This enables the installation of an LED tube into linear fixtures that vary slightly in length. When the elastic component 24 is not pressed, a distance of separation between the power connectors 25 and the power pins is in a range of 2-10 mm approximately.

Figure 7:
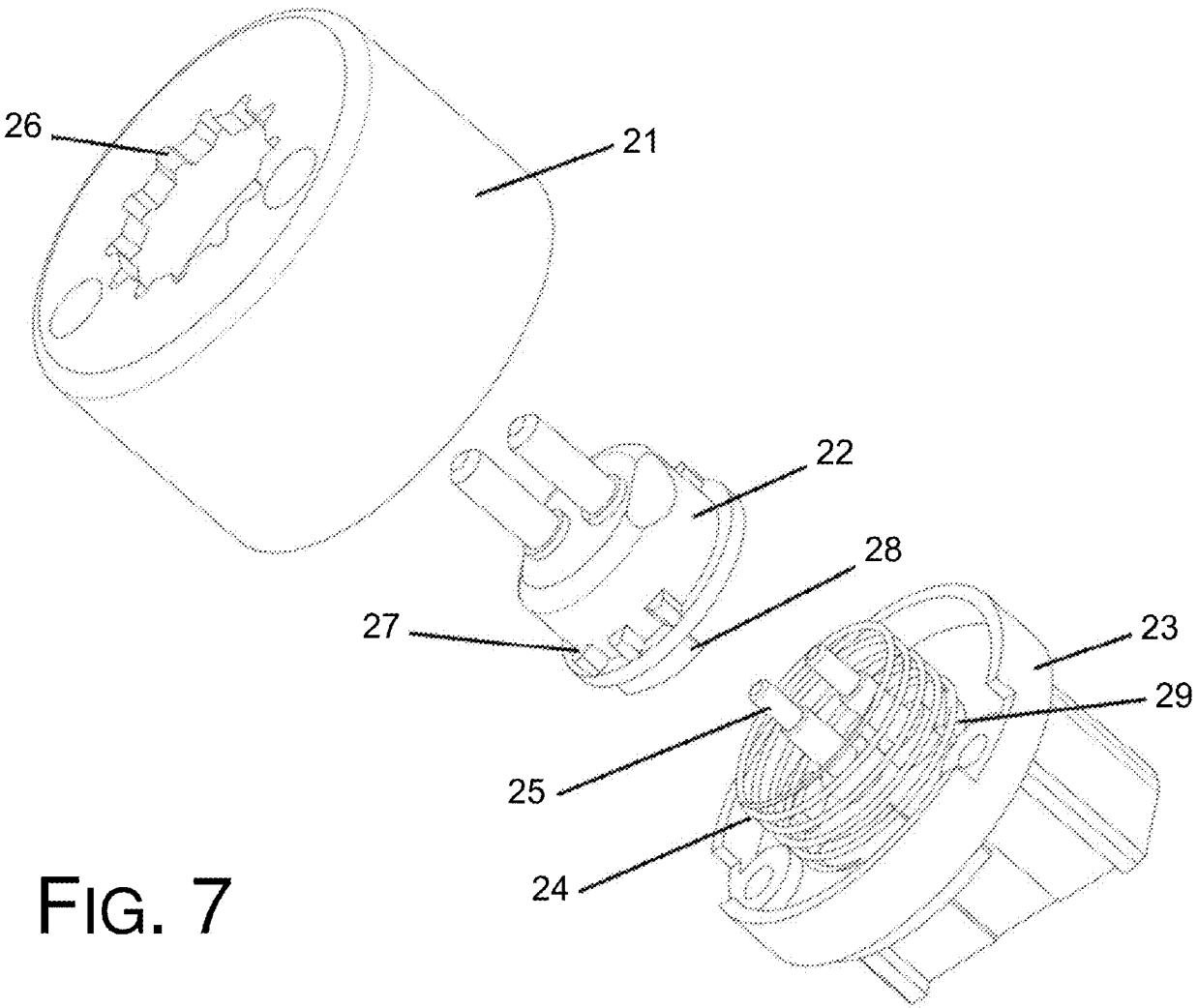
FIG. 7 schematically depicts an exploded view of an embodiment of the present disclosure.

FIG. 7 illustrates an exploded view of the current implementation example. A center opening 26 of the end-cap housing 1 has a gear-style form, e.g., serrated profile, that matches gear-like protrusions 27 that are disposed at least partially around the periphery of the power-pin assembly 22. When the power-pin assembly 22 is not pressed, the elastic component 24 pushes the power-pin assembly 22 upward into the end-cap housing, causing the gear-like protrusions 27 of the power-pin assembly 22 into a lock position with the center opening 26 of the end-cap housing 21. When the power-pin assembly 22 is pressed, the gear-like protrusions 27 are released from the lock of the center opening 26, and at this time the power-pin assembly 22 can rotate in each direction, e.g., up to 90 degrees in both directions (up to −90 degrees and 90 degrees).

Figure 8:
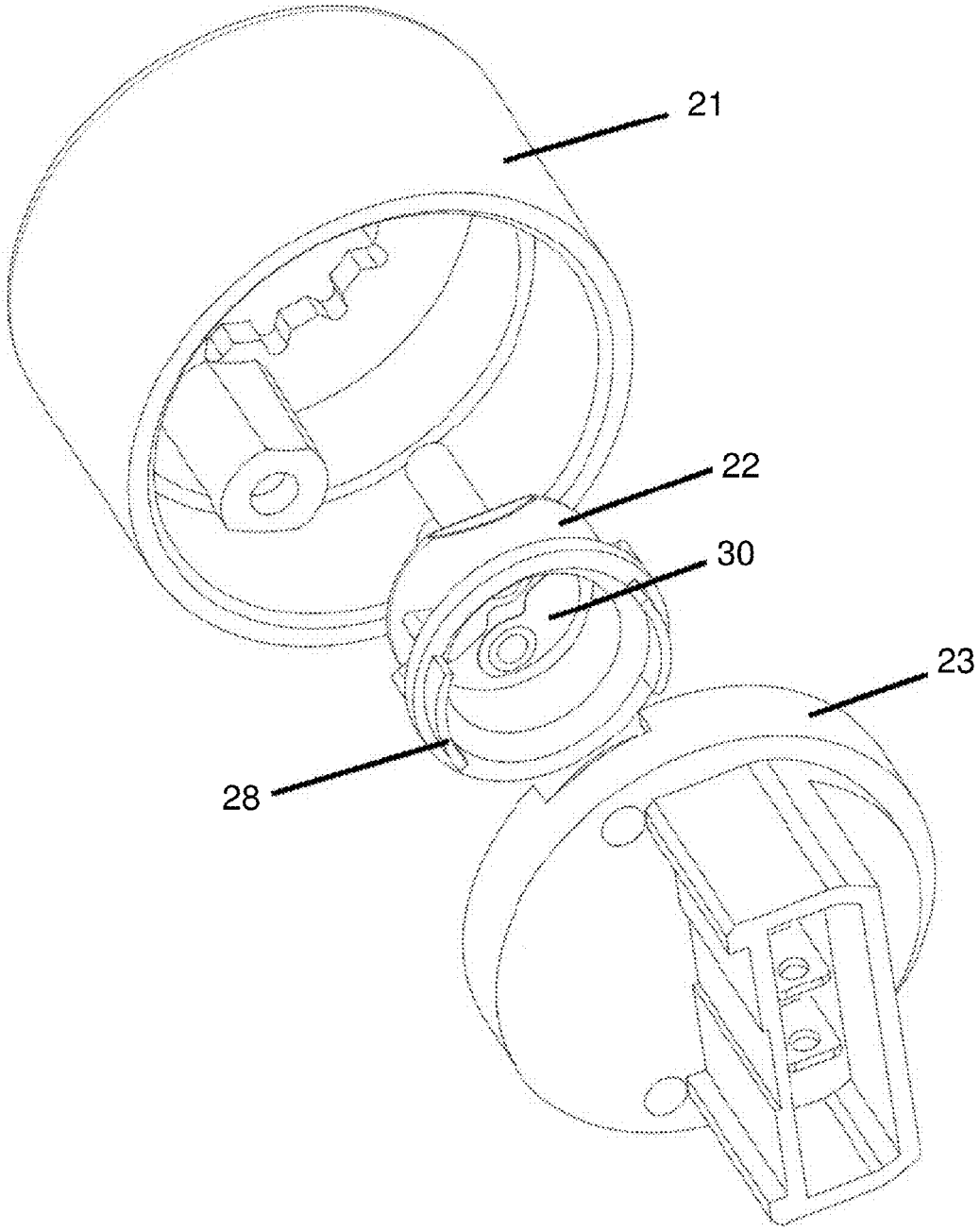
FIG. 8 schematically depicts an exploded view of an embodiment of the present disclosure from another angle.

FIG. 8 shows that there are two electricity-conducting surface areas 30 at the end of the two pins inside the power-pin assembly 22. They ensure that when the power-pin assembly 22 is rotated, the two power connectors 25 remain electrically connected with the two pins on the power-pin assembly 22 while the elastic component 24 is pressed.

Referring to FIG. 7, in order to keep the elastic component 24 stationary inside the end-cap, the current implementation example includes two wedges 29 on the end-cap base assembly 23 positioned inside the elastic component 24 and two wedges 28 on the bottom of the power-pin assembly 22 positioned outside of the elastic component 24.

Another benefit of this implementation is that the complete end-cap can be assembled in advance, prior to be attached to the LED tube body, thus enabling a modular process for manufacturing the LED tube. This allows the end-cap to be made and sold independently of the LED tube.

Additional and Alternative Implementation Notes

Although the techniques have been described in language specific to certain applications, it is to be understood that the appended claims are not necessarily limited to the specific features or applications described herein. Rather, the specific features and examples are disclosed as non-limiting exemplary forms of implementing such techniques.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

For the purposes of this disclosure and the claims that follow, the terms "coupled" and "connected" may have been used to describe how various elements interface. Such described interfacing of various elements may be either direct or indirect.

What is claimed is:

1. An end-cap of a light-emitting diode (LED) tube, comprising:

an end-cap housing;

a power-pin assembly;

an end-cap base assembly; and a first elastic component disposed between the power-pin assembly and the end-cap base assembly, wherein:

the power-pin assembly includes at least one power pin thereon, the at least one power pin configured to connect to an external power source, the power-pin assembly protrudes out of a center opening of the end-cap housing, the end-cap base assembly includes at least one power connector thereon, the at least one power connector configured to connect to a body of the LED tube to supply power to the LED tube, the first elastic component resides inside the end-cap housing and is configured to render and separate a connection between the at least one power connector and the power-pin assembly, the at least one power connector connects to the at least one power pin when the first elastic component is pressed, the at least one power connector remains separate from the at least one power pin when the first elastic component is not pressed, and the at least one power connector comprises a second elastic component which is configured to adjust a length of the LED tube when the second elastic component is pressed.

2. The end-cap of claim 1, wherein an interlocking mechanism exists between the end-cap housing and the power-pin assembly such that the power-pin assembly is rotatable inside the center opening of the end-cap housing.

3. The end-cap of claim 2, wherein the interlocking mechanism comprises a gear-style lock between the end-cap housing and the power-pin assembly such that, when the power-pin is pressed into the center opening of the end-cap housing, the power-pin assembly is released from the gear-style lock and becomes rotatable, and when the power-pin assembly is released, the first elastic component pushes the power-pin assembly into a gear locked position with the center opening of the end-cap housing.

4. The end-cap of claim 3, wherein there is at least one electricity-conducting surface area at an end of the at least one power pin that connects with the at least one power connector such that, when the power-pin assembly is rotated, the at least one electricity-conducting surface area remains electrically connected with the at least one power connector while the first elastic component is pressed.

5. The end-cap of claim 2, wherein a rotational range of the power-pin assembly in the center opening of the end-cap housing is approximately −90 to 90 degrees.

6. The end-cap of claim 1, wherein the second elastic component of the at least one power connector comprises an elastic cylindroid.

7. The end-cap of claim 6, wherein the second elastic component is a spring.

8. The end-cap of claim 1, wherein the second elastic component enables the at least one power connector to retract in a direction along a longitudinal axis of the LED tube, and wherein a retracting range of the at least one power connector is 1-10 mm approximately.

9. The end-cap of claim 1, wherein the first elastic component comprises a spring.

10. The end-cap of claim 1, wherein a mechanism exists to keep a position of the first elastic component stationary inside the end-cap.

11. The end-cap of claim 10, wherein the mechanism comprises at least one first wedge on the end-cap base assembly positioned inside the first elastic component and at least one second wedge on the power-pin assembly positioned outside of the first elastic component.

12. The end-cap of claim 1, wherein, when the first elastic component is not pressed, a distance of separation between the at least one power connector and the at least one power pin is in a range of 2-10 mm approximately.

* * * * *